US011026525B2

(12) United States Patent
Barzee

(10) Patent No.: US 11,026,525 B2
(45) Date of Patent: Jun. 8, 2021

(54) ADJUSTABLE VERTICAL CAN STORAGE AND DISPENSER RACK

(71) Applicant: Sid Barzee, Kuna, ID (US)

(72) Inventor: Sid Barzee, Kuna, ID (US)

( * ) Notice: Subject to any disclaimer, the term of this patent is extended or adjusted under 35 U.S.C. 154(b) by 0 days.

(21) Appl. No.: 16/711,211

(22) Filed: Dec. 11, 2019

(65) Prior Publication Data

US 2020/0178705 A1 Jun. 11, 2020

Related U.S. Application Data

(60) Provisional application No. 62/777,864, filed on Dec. 11, 2018.

(51) Int. Cl.

| | |
|---|---|
| ***A47F 5/00*** | (2006.01) |
| ***A47F 7/28*** | (2006.01) |
| ***A47F 1/08*** | (2006.01) |
| ***A47B 81/00*** | (2006.01) |
| ***A47F 5/08*** | (2006.01) |
| ***A47B 73/00*** | (2006.01) |
| ***A47B 45/00*** | (2006.01) |
| ***A47F 7/00*** | (2006.01) |
| ***A47F 5/16*** | (2006.01) |

(52) U.S. Cl.

CPC ..... *A47F 5/0093* (2013.01); *A47B 45/00* (2013.01); *A47B 73/008* (2013.01); *A47B 81/007* (2013.01); *A47F 1/08* (2013.01); *A47F 5/08* (2013.01); *A47F 5/0846* (2013.01); *A47F 5/0853* (2013.01); *A47F 7/0007* (2013.01); *A47F 7/281* (2013.01); *A47F 2005/165* (2013.01)

(58) Field of Classification Search

CPC ..... A47F 5/0093; A47F 1/08; A47F 7/281; A47F 2005/165; A47F 7/007; A47F 5/08; A47F 5/0846; A47F 5/0853; A47F 1/082; A47F 1/085; A47F 1/087; A47F 1/00; A47F 1/10; A47F 1/106; A47F 5/005; A47F 5/16; A47F 7/28; A47F 7/283; A47F 7/285; A47F 7/0014; A47F 5/0838; A47F 7/0007; A47B 81/007; A47B 73/008; A47B 45/00; A47B 73/00; A47G 23/0266; A47G 23/0258; A47G 23/0241

USPC .... 211/74, 75, 59.2, 175, 94.01, 87.01, 193, 211/49.1, 184, 85.18; 312/35, 45, 42, 49, 312/60, 72; 221/131, 92, 242, 241

See application file for complete search history.

(56) References Cited

U.S. PATENT DOCUMENTS

| | | | | |
|---|---|---|---|---|
| 1,059,963 A * | 4/1913 | Huhn | ..... | A47F 1/08 312/60 |
| 1,673,812 A * | 6/1928 | Dunn | ..... | A47F 1/08 312/42 |
| 1,714,469 A * | 5/1929 | Hoffman | ..... | A47F 1/08 312/45 |
| 2,342,452 A * | 2/1944 | Casteen | ..... | A47F 1/08 312/42 |

(Continued)

*Primary Examiner* — Jennifer E. Novosad

(74) *Attorney, Agent, or Firm* — Hogaboam Law Offices, PLLC; Romney J. Hogaboam

(57) ABSTRACT

A storage and dispensing system for generally cylindrical items which is adjustable to accommodate items having a variety of heights and diameters. The width of the storage and discharge areas, depth of the storage area, and height of the discharge chute are adjustable. The system holds items for removal on a first-in, first-out basis.

6 Claims, 9 Drawing Sheets

(56) References Cited

U.S. PATENT DOCUMENTS 2,860,941 A * 11/1958 Fromwiller ..... A47F 1/08 312/36
D189,736 S * 2/1961 Combs ..... D6/517
3,010,606 A * 11/1961 Heselov ..... A47F 1/08 221/92
3,018,001 A * 1/1962 Combs ..... A47F 1/08 211/59.2
3,152,697 A * 10/1964 Berman ..... A47F 1/082 211/59.2
3,287,073 A * 11/1966 Holtkamp ..... A47F 3/0486 312/36
3,360,091 A * 12/1967 Baum ..... G07F 11/10 194/225
3,858,757 A * 1/1975 Langdon, Jr. ..... A47F 1/08 221/92
3,883,038 A * 5/1975 Bookout ..... G07F 11/24 221/67
3,957,174 A * 5/1976 Palamara ..... A47F 1/08 221/111
4,006,824 A * 2/1977 Snediker ..... A47F 1/04 211/59.2
4,015,885 A * 4/1977 Baggaley ..... A47F 1/082 312/42
4,037,756 A * 7/1977 Jaquish ..... A47F 1/08 221/242
4,096,969 A * 6/1978 Ragusa ..... G07F 11/00 221/199
4,148,413 A * 4/1979 Immordino ..... A47F 1/08 211/59.2
4,305,628 A * 12/1981 Glasener ..... A47F 1/08 312/42
4,396,237 A * 8/1983 Henry ..... A47F 1/08 211/59.2
4,503,982 A * 3/1985 Lewis ..... A47F 5/005 108/61
4,542,830 A * 9/1985 Effort ..... A47F 5/112 211/49.1
4,566,596 A * 1/1986 Hennig ..... A47F 1/08 211/189
4,685,590 A * 8/1987 Negishi ..... G07F 11/34 221/241
4,850,511 A * 7/1989 Kral ..... A47F 1/08 221/154
4,881,787 A * 11/1989 King ..... A47F 1/08 312/42
4,986,615 A * 1/1991 Hieb ..... G07F 11/08 211/59.2
5,000,344 A * 3/1991 Janssen ..... A47F 1/08 221/92
5,046,639 A * 9/1991 Deberry ..... A47F 1/10 221/127
5,127,546 A * 7/1992 Chen ..... G07F 11/007 221/203
5,284,257 A * 2/1994 Schum ..... A47F 5/0846 211/128.1
5,316,154 A * 5/1994 Hajec, Jr. ..... A47F 1/08 211/59.2
5,361,937 A * 11/1994 Wiese ..... A47F 1/08 211/150
5,529,207 A * 6/1996 Oden ..... G07F 11/04 221/67
5,611,456 A * 3/1997 Kasper ..... B65H 1/06 221/129
5,667,082 A * 9/1997 Hamilton ..... A47F 1/08 211/15
5,700,075 A * 12/1997 Perone ..... A47F 1/08 221/131
5,862,943 A * 1/1999 Larit ..... A47F 1/08 221/131
5,865,324 A * 2/1999 Jay ..... A47F 1/12 211/59.2
6,427,866 B1 * 8/2002 Hawker ..... A47F 1/08 221/132
6,494,328 B1 * 12/2002 Barrett ..... A47F 1/08 211/59.2
D497,504 S * 10/2004 Lledo ..... D6/516
7,150,361 B2 * 12/2006 Calleja ..... A47F 7/0021 211/49.1
7,857,148 B2 * 12/2010 Roeske ..... A47F 1/126 211/59.3
8,191,719 B2 * 6/2012 van Ooyen ..... A47F 1/04 211/87.01
8,657,126 B1 * 2/2014 Loftin ..... A47F 1/087 211/59.2
9,226,598 B1 * 1/2016 Knope ..... A47F 1/085
2004/0011751 A1 * 1/2004 Johnson ..... A47F 1/087 211/59.2
2005/0023939 A1 * 2/2005 Kramer ..... G07F 17/0071 312/45
2006/0243683 A1 * 11/2006 Onachilla ..... A47F 5/08 211/59.2
2008/0251474 A1 * 10/2008 Weiss ..... A47F 1/06 211/49.1
2014/0069880 A1 * 3/2014 Spilotro ..... A47B 81/00 211/49.1
2016/0058204 A1 * 3/2016 Bernard ..... A47F 1/087 211/59.2
2016/0135613 A1 * 5/2016 Jones ..... A47K 10/22 211/85.5
2019/0279456 A1 * 9/2019 Wilson ..... A47F 7/0035
2020/0178705 A1 * 6/2020 Barzee ..... A47B 57/585

* cited by examiner

ADJUSTABLE VERTICAL CAN STORAGE AND DISPENSER RACK

CROSS-REFERENCE TO RELATED APPLICATIONS

This application claims priority to provisional application 62/777,864 filed on Dec. 11, 2018.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

REFERENCE TO A "SEQUENCE LISTING," A TABLE, OR A COMPUTER PROGRAM LISTING APPENDIX SUBMITTED ON COMPACT DISC AND AN INCORPORATION-BY-REFERENCE OF THE MATERIAL ON THE COMPACT DISC

Not Applicable

STATEMENT REGARDING PRIOR DISCLOSURES BY AN INVENTOR OR JOINT INVENTOR

Not Applicable

BACKGROUND OF THE INVENTION

Current cylindrical can storage shelves fit the average sized can and are often not adjustable to varying cans with different heights and diameters. The shelves are made to fit the most "standard" can sizes and may not adjust to smaller or larger cans with varying heights and diameters. Current storage shelves often use a gravity feed "z" shaped stair step system which allows cans to roll from high to low elevations on and through several different elevated tiers. Cans with dimensions which differ from a "standard" can may not roll down due to too much or too little space to support the can throughout the elevated tiers.

DESCRIPTION OF RELATED ART INCLUDING INFORMATION DISCLOSED UNDER 37 CFR 1.97 AND 37 CFR 1.98

Not Applicable

BRIEF SUMMARY OF THE INVENTION

A storage and dispensing system for generally cylindrical items which is adjustable to accommodate items having a variety of lengths and diameters. The width of the storage and discharge areas, depth of the storage area, and height of the discharge chute are adjustable. The system holds items for removal on a first-in, first-out basis.

DETAILED DESCRIPTION OF THE INVENTION

Figure 1:
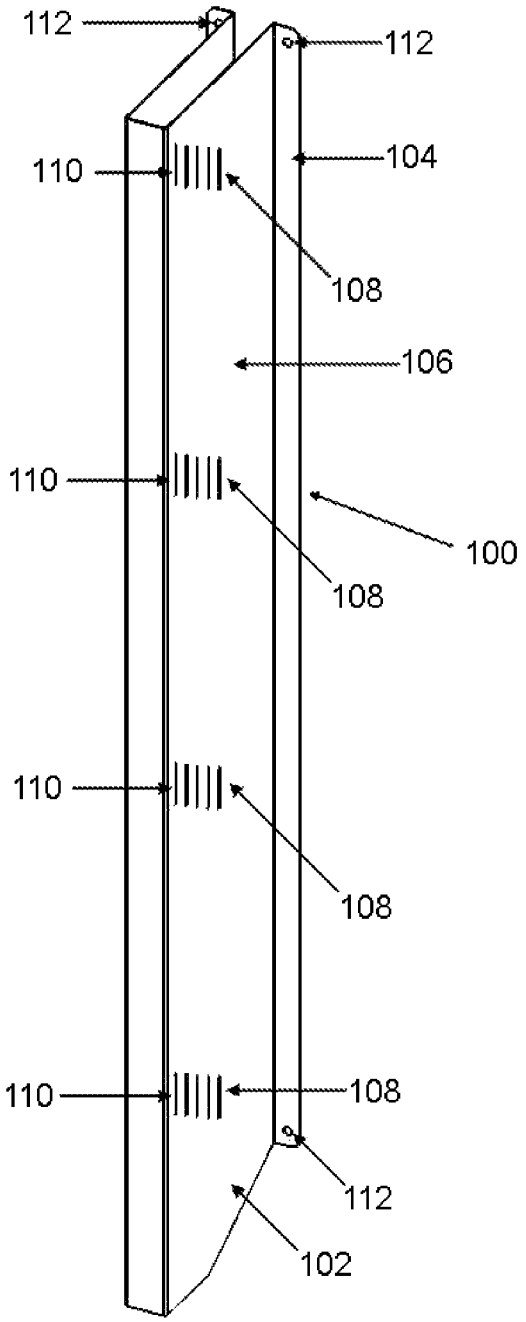
FIG. 1 shows a side perspective view of a substantially solid side member of the storage region of the present invention.

The following description and the referenced drawings provide illustrative examples of that which the inventor regards as his invention. As such, the embodiments discussed herein are merely exemplary in nature and are not intended to limit the scope of the invention, or its protection, in any manner. Rather, the description and illustration of these embodiments serve to enable a person of ordinary skill in the relevant art to practice the invention.

The use of "e.g.," "etc," "for instance," "in example," "for example," and "or" and grammatically related terms indicates non-exclusive alternatives without limitation, unless otherwise noted.

The use of "including" and grammatically related terms means "including, but not limited to," unless otherwise noted.

The use of the articles "a," "an" and "the" are meant to be interpreted as referring to the singular as well as the plural, unless the context clearly dictates otherwise. Thus, for example, reference to "a rail" includes two or more such rails, and the like.

The use of "optionally," "alternatively," and grammatically related terms means that the subsequently described element, event or circumstance may or may not be present/occur, and that the description includes instances where said element, event or circumstance occurs and instances where it does not.

The use of "preferred," "preferably," and grammatically related terms means that a specified element or technique is more acceptable than another, but not that such specified element or technique is a necessity, unless the context clearly dictates otherwise.

The use of "exemplary" means "an example of" and is not intended to convey a meaning of an ideal or preferred embodiment.

As used herein, the term "can" means any type of container, including but not limited to sealed metal containers, glass containers, and paper containers, unless the context clearly dictates otherwise.

Several exemplary can rack systems are disclosed and illustrated herein.

In a first exemplary embodiment, the can rack system is comprised of two regions: a storage region and a dispensing region. When viewed from the side, the storage region preferably has a generally rectangular cross section. When viewed from the side, the dispensing region preferably has a right trapezoidal cross section where the side not meeting the other sides at right angles is at the bottom and back of the can rack system.

Anchor System

The can rack system is preferably anchored to a flat vertical surface, such as a wall, using intermediate hardware mounted to the surface. In a preferred embodiment, the can rack system anchor hardware includes an upper generally horizontal rail 602 and a lower generally horizontal rail 608 both of which are attached to a fixed surface (such as a wall) using appropriate means such as "L-brackets" 604. In a preferred embodiment, the rails 602 and 608 permit attachment at a variety of locations along the length of the rails. In a preferred embodiment, the rails 602 and 608 are T-slot extruded aluminum.

The anchor system is preferably mounted to the flat vertical surface with a mechanism which allows the attachment points to have adjustable centering distances to facilitate attaching the can rack system to be attached to studs spaced various distances apart. In a preferred embodiment, the mounts are L-shaped brackets 604 which mount to the top of the anchor system and a wall at a point above the anchor system using standard wood screws. In an alternative embodiment, the mounts are attached to the fixed surface using a form of drywall anchor.

The anchor system further preferably further comprises bottom supports 606. The bottom supports 606 are preferably shaped and configured to support downward weight of the apparatus and/or the apparatus' contents.

In an alternative embodiment, the can rack system is free-standing with features of a free-standing system providing one or more wall-like surfaces to which the anchor system may be attached.

Vertical Dividers (Sides)

Figure 2:
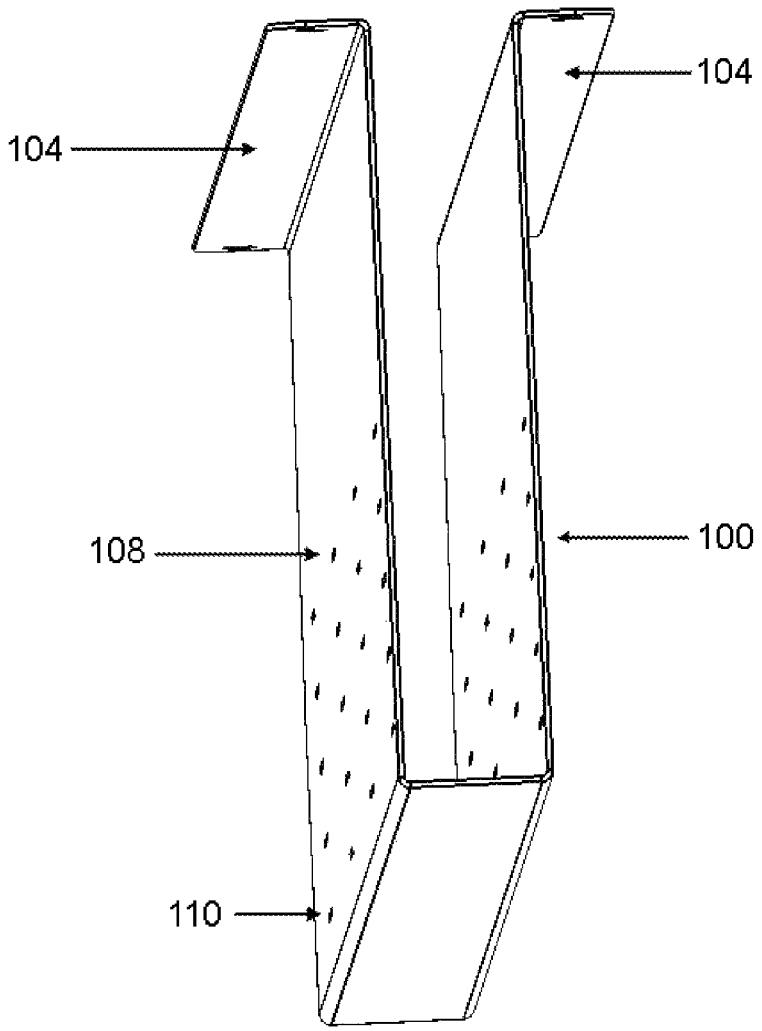
FIG. 2 shows top perspective view of a substantially solid side member of the storage region of the present invention.
Figure 3:
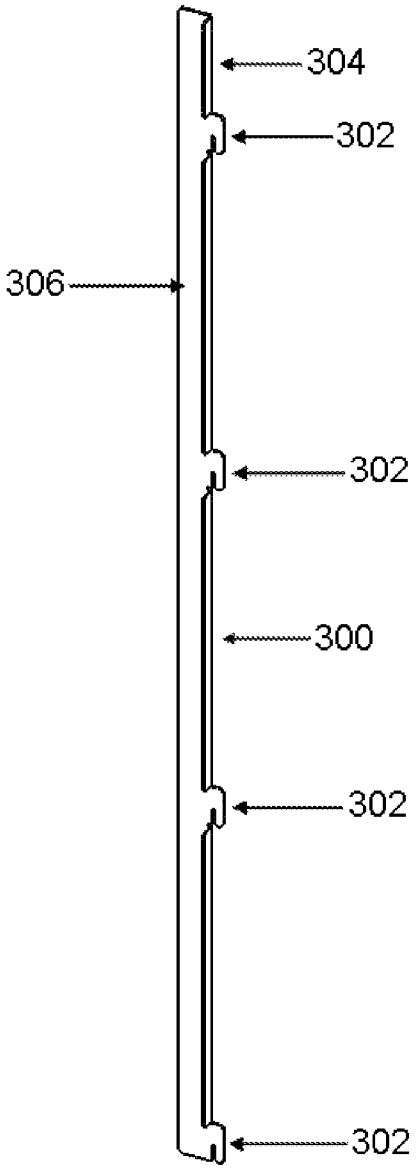
FIG. 3 shows a side perspective view of a front member of the storage region of the present invention.

The can rack system preferably has a plurality of vertical dividers 100. A vertical divider 100 is characterized primarily by a vertical substantially flat surface 106. Each adjacent pair of vertical dividers 100 define separate storage and dispensing regions with vertical dividers 100 which are not at either end of the system forming the side of two storage and dispensing regions, one on either side. The depth of the storage regions, back to front, are constrained by the depth of the vertical dividers since the vertical dividers form the left and right sides of the storage and dispensing regions. In a preferred embodiment, the vertical dividers 100 have a "serif U" cross section when viewed from the top (as shown in FIG. 2). In an alternative embodiment, the vertical dividers are sufficiently thick to be sufficiently rigid and allow appropriate features to be attached to both sides of the vertical divider. In a preferred embodiment, the vertical dividers 100 are configured to allow the spacing between the vertical dividers to be adjusted.

In a preferred embodiment, the vertical dividers 100 are attached to the anchor system. In this preferred embodiment, the distance between vertical dividers is adjustable to accommodate cans of different heights (802, 902, 904, 906, 908). The vertical dividers are configured with features 112 which facilitate their attachment to the anchor system. When the anchor system is comprised of T-slot extruded aluminum, the features 112 preferably include holes and/or vertical slots. In the case of holes 112, the height of the vertical dividers 100 relative to the anchor system is fixed. In the case of vertical slots, the height of the vertical dividers 100 relative to the anchor system is variable. In a preferred embodiment, the vertical dividers 100 are configured with holes at the bottom for attachment to the bottom rail 608 of the anchor system and vertical slots at the top for attachment to the top rail 602 of the anchor system.

Means to attach the vertical dividers 100 to the anchor system may further include captive screws. When captive screws are used in conjunction with slots in the vertical dividers 100, the captive screws are attached to the vertical dividers 100 in a means which allows the captive screws to traverse at least a portion of the rails 602 and 608.

The vertical dividers 100 further preferably contain a series of sets of guides 108 and 110 on one or both sides. The distance between the sets of guides 108 and 110 and the edge of the vertical divider configured to be installed adjacent to the anchor system is selected to correspond to common cylindrical can diameters. In a preferred embodiment, the distance between the guides 108 and 110 in a set and the back of the storage section is approximately one can diameter such that when the storage area is filled with cans, the cans 802, 902, 904, 906, and 908 form a substantially vertical stack causing the majority of the weight of the cans to be directed down. In an alternative embodiment, the distance between the guides 108 and 110 in a set and the back of the storage section is between one and two can diameters such that when the storage area is filled with cans, the cans form a zig-zag pattern to allow a relatively large number of cans to be stored in a particular storage region.

Back

In a preferred embodiment of the can rack system, features in vertical dividers 100 define the back 104 of the storage regions. In this preferred embodiment, the top and bottom of cans 802, 902, 904, 906, and 908 contact the "serifs" 104 of the respective vertical dividers 100. In an alternative embodiment, the can rack system uses one or more back member to define the backs of the storage regions. In this first alternative embodiment, the back is preferably approximately the height of the storage and dispensing regions combined and narrow relative to the height of cans. In a second alternative embodiment, the fixed surface to which the can rack system is attached defines the back of the storage region.

Guides

Each guide in a set of guides 108 or 110, in or on a vertical divider 100, is aligned such that when a substantially straight front member 300 is attached to the guides in the set, the front member 300 will contact each guide in the set 108 or 110. Each set of guides 108 or 110 is preferably a different distance from the back of the storage region permitting a user to alter the depth of the storage region by placing a front wall behind or in a set of guides. In a preferred embodiment, the guides are one or more slots 108 or 110 configured to cooperatively interact with features in a front member. In an alternative embodiment, the guides are a series of "L-shaped" protrusions configured to cooperatively interact with features in a front member.

The guides 108 or 110 are further configured, in conjunction with front members 300, to set the lower bound of a front member 300 when a front member 300 is installed in a set of guides.

Front Member(s)

Figure 4:
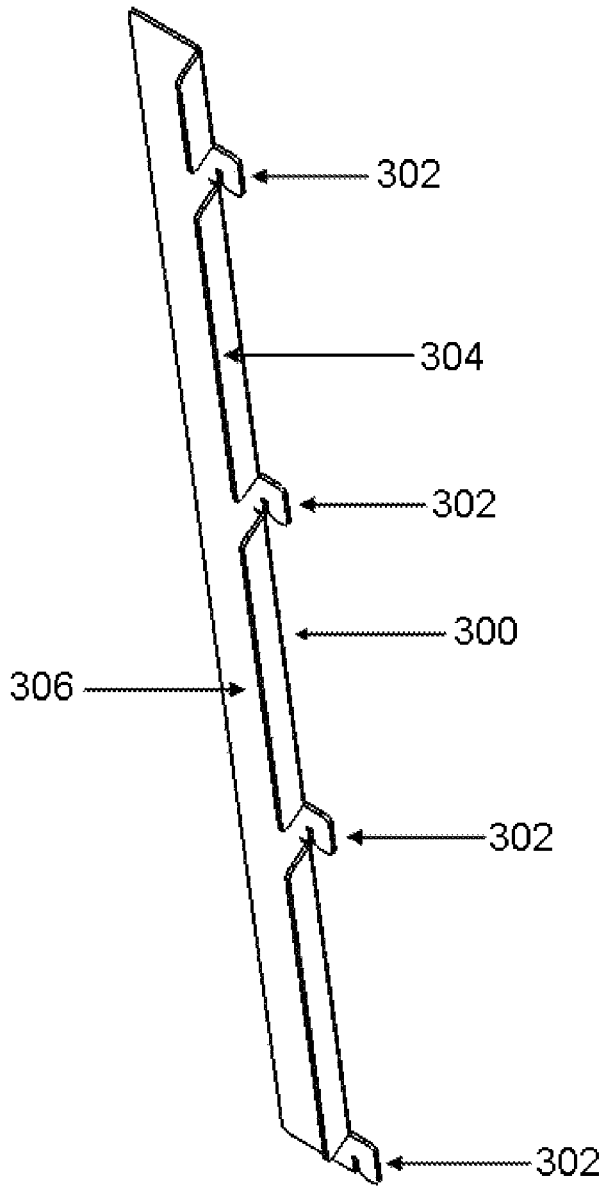
FIG. 4 shows a top perspective view of a front member of the storage region of the present invention.
Figure 5:
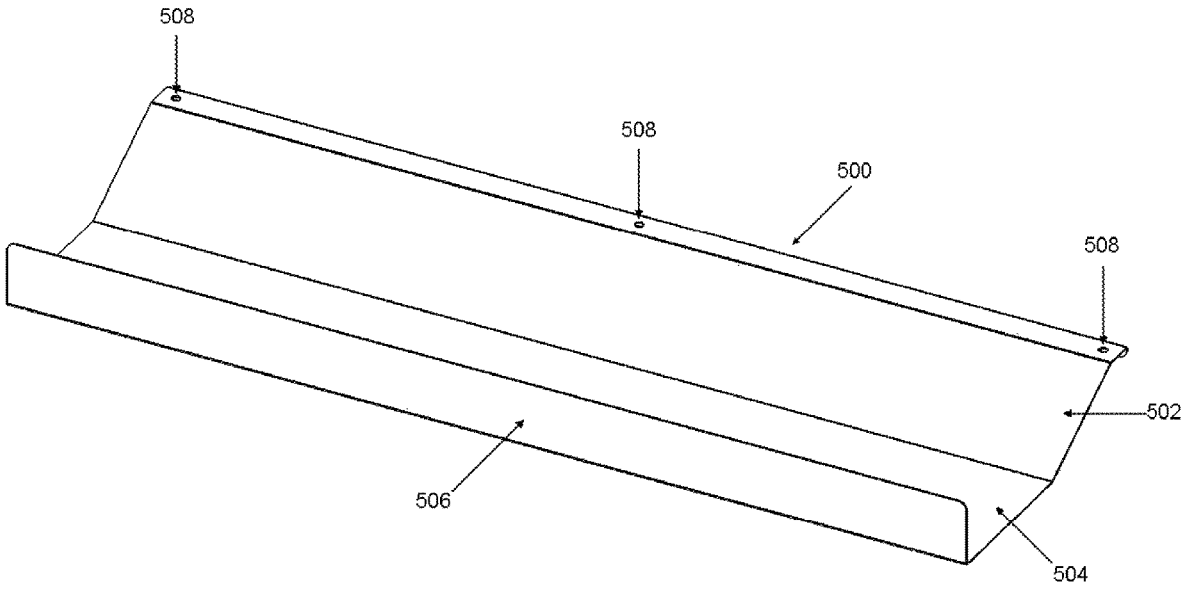
FIG. 5 shows a back, bottom, and front stop member of the dispensing region of the present invention.
Figure 6:
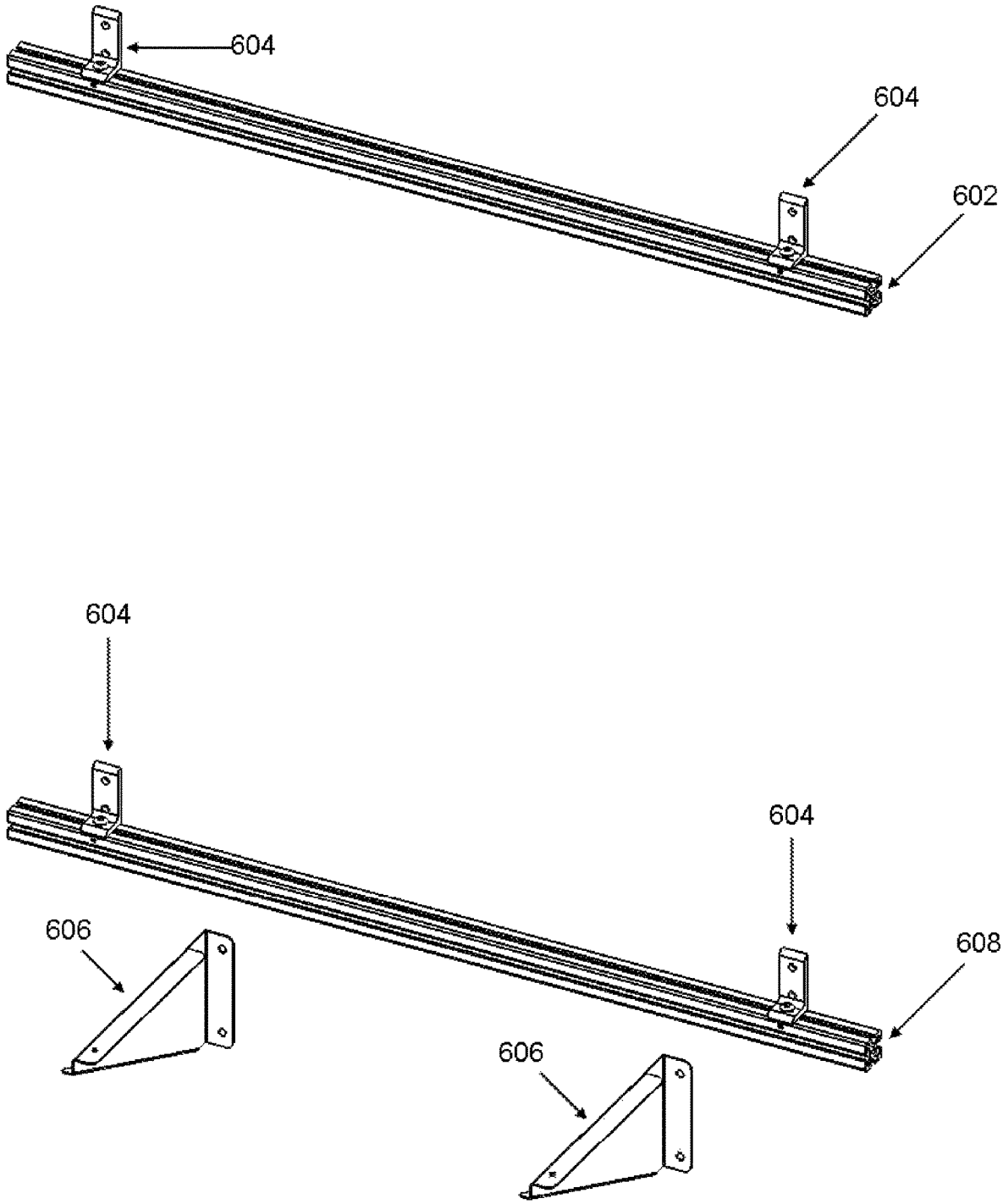
FIG. 6 shows attachment hardware usable to mount the present invention on a vertical surface.
Figure 7:
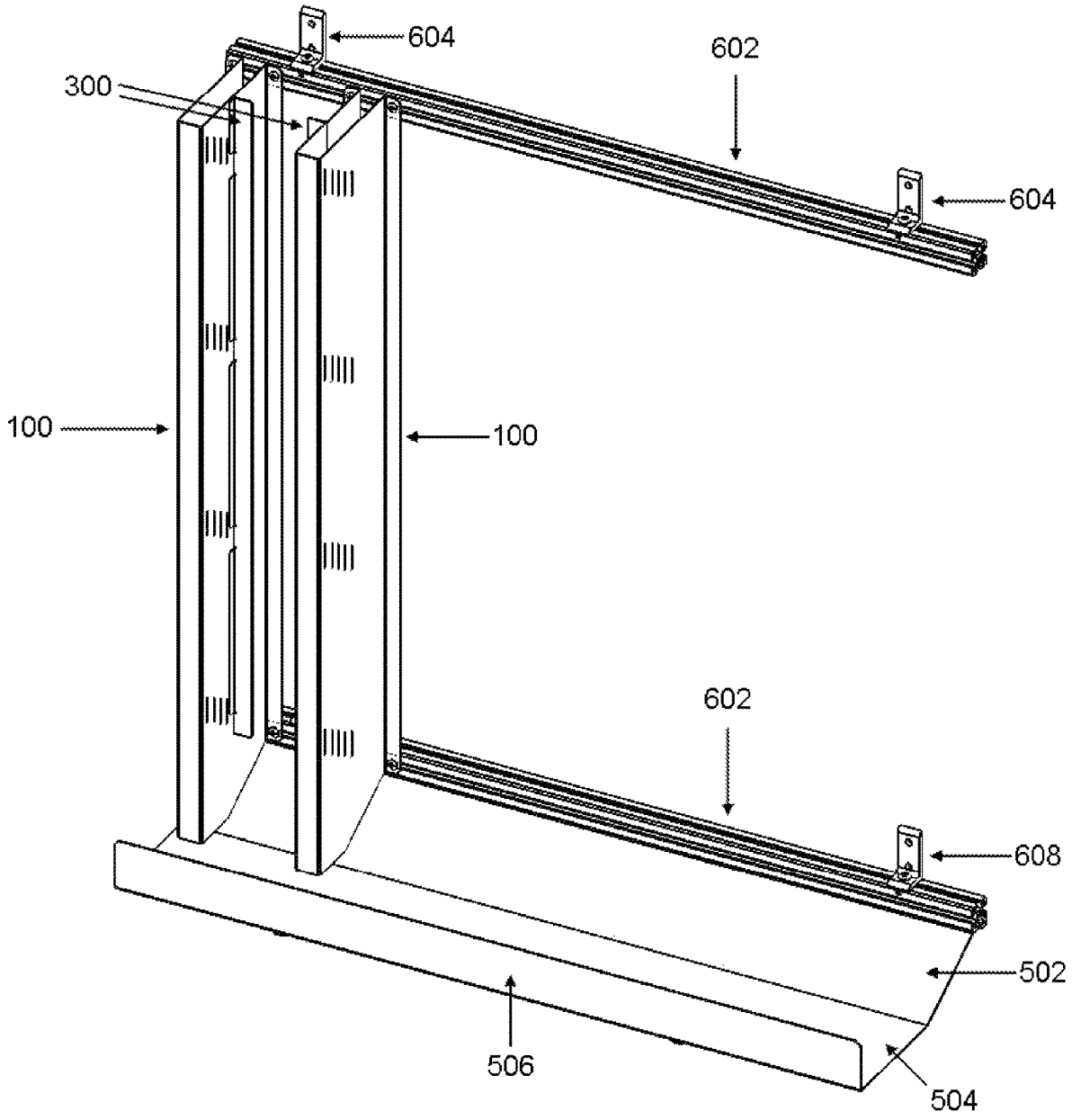
FIG. 7 shows attachment hardware, two substantially solid side members of the storage region and a back, bottom, and front stop member of the dispensing region installed on a vertical surface.
Figure 8:
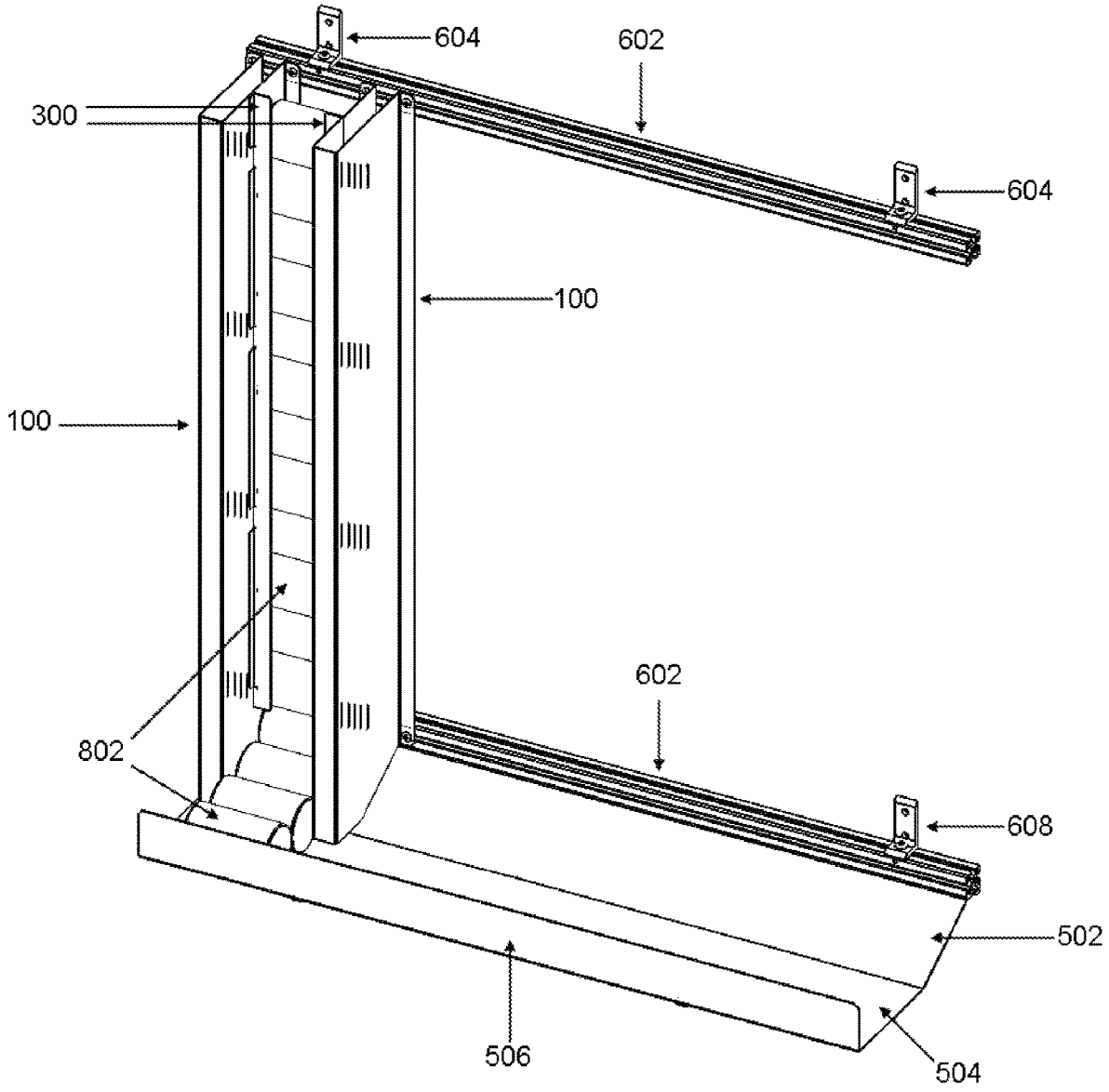
FIG. 8 shows one series of cans installed in a device of the present invention.
Figure 9:
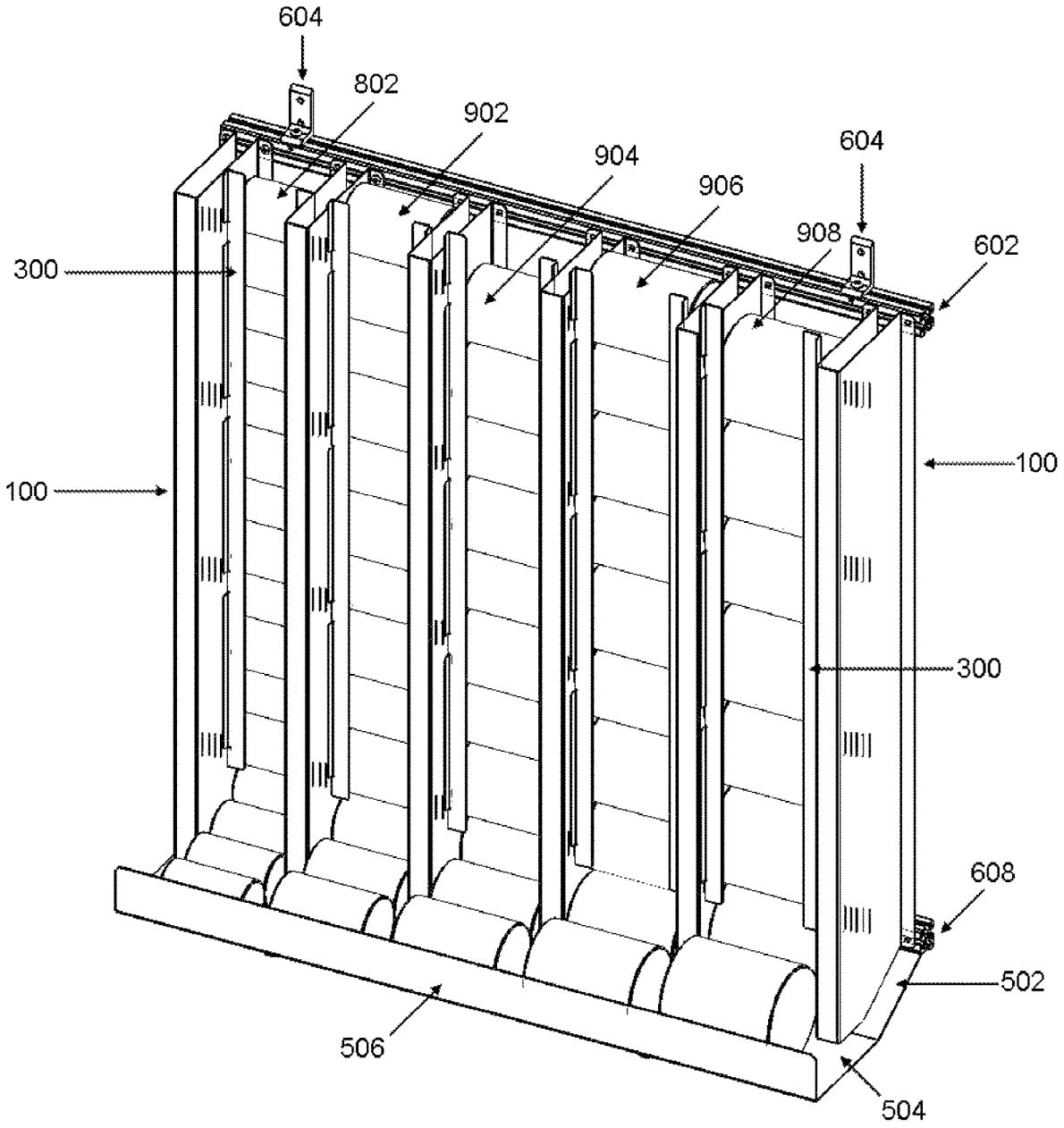
FIG. 9 shows five series of cans of various sizes installed in a device of the present invention.

One or more front members 300 define the front of the storage region. The bottom of the front member defines the bottom of the storage region. In a preferred embodiment, the front member 300 has a "capital T" shaped cross section when viewed from the top (as shown in FIG. 4). The vertical portion 304 of the "capital T" is configured to be installed parallel to a vertical divider 100. One of the top branches of the "capital T" contains features, such as slotted ears 302, configured to cooperatively interact with guide features 108 and 110. The opposing top branch of the "capital T" 306 is configured to extend, approximately perpendicularly, away from the vertical divider thereby forming a front of the storage region. In a preferred variant of this embodiment, the length of the top branch 306 extending away from the vertical divider 100 is significantly less than half the height of the cans sought to be stored in the can rack system thereby leaving a gap between left and right front members 300 permitting a consumer to see information on the cans and stock level.

In an alternative embodiment, the front members have a "serif U" shaped cross section when viewed from the top. The serif portions of the "serif U" front members are configured to cooperatively interact with guide features 300 of the vertical dividers. In a preferred variation of this embodiment, the height of the "serif U" is significantly less than half the height of the cans sought to be stored in the can rack system thereby leaving a gap between left and right front members permitting a consumer to see information on the cans and stock level.

In a preferred embodiment, installing a front member 300 in a set of guides 108 and 110 sets the height of the bottom of the front member 300. The height of the bottom of the front member 300 is selected based on the diameter of the cans to be stored and dispensed. The distance between the bottom of the front member 300 and the nearest portion of the dispenser 500 is preferably approximately one can diameter thereby permitting cans to pass past the bottom of the front member one at a time.

Bottom Support(s)

In a preferred embodiment, the can rack system further comprises one or more bottom support(s) 606. The bottom support(s) 606 is/are preferably configured to be attached to the anchor system. The distance of the bottom support(s) 606 from the anchor system is selected in conjunction with the dimensions of the dispenser 500 to cause the opening at the front of the dispensing region to be the desired size when the front members 300 are attached to a particular set of guides 108 and 110. In an alternative embodiment, the bottom support(s) 606 are attached to the same surface as the anchor system using standard wood screws. In an alternative embodiment, the bottom support(s) 606 are attached to the same surface as the anchor system using a form of drywall anchor.

In a preferred embodiment, the bottom support(s) 606 is/are configured to have a dispenser 500 attached to it/them. In a preferred embodiment, the bottom support 606 is configured with an embedded nut selected to accept a screw passing through the dispenser 500 to attach the dispenser 500 to the bottom support 606.

Dispenser

In a preferred embodiment, the can rack system further comprises a dispenser 500. In a preferred embodiment, the dispenser 500 attaches to the lower rail 608 of the anchor system. In a first alternative embodiment, the dispenser 500 is attached to the same surface as the anchor system. In a second alternative embodiment, the anchor system is attached to the bottom support(s) 606.

The dispenser 500 preferably comprises a back portion 502, a bottom portion 504, and a stop portion 506. The back portion 502 is preferably angled and is preferably located at the rear of the dispenser adjacent the anchor system. In a preferred embodiment, the angle between the bottom of the back portion 502 of the dispenser 500 and the flat surface to which the can rack system is attached is approximately 60 degrees. At the end of the dispenser 500 opposite the anchor system there is preferably a stop portion 506. In a preferred embodiment, the stop portion 506 is comprised of a projection, approximately perpendicular to the bottom portion 504 with a length at least half the maximum diameter of can for which the can rack system is configured to accept, extending the length of the dispenser 500.

In a preferred embodiment, the dispenser 500 is configured to be attached to an anchor system. In this preferred embodiment, the dispenser 500 is configured with features, such as holes 508 through which fasteners may be passed to secure dispenser 500 to anchor system. In a preferred embodiment, the fasteners are bolts which attach to T-slot extruded aluminum 608.

In a preferred embodiment, the dispenser 500 is configured to be attached to an anchor system 600. In this preferred embodiment, the dispenser 500 is configured with features, such as holes 508 through which fasteners may be passed to secure dispenser 500 to anchor system 600. In a preferred embodiment, the fasteners are bolts which attach to T-slot extruded aluminum 608.

In a preferred embodiment, the dispenser 500 is configured to be attached to the bottom support(s) 606. In a preferred embodiment, the dispenser 500 is configured with lateral slots having a height approximately the diameter of fasteners used to fasten the dispenser 500 to the bottom support(s) 606 allowing the bottom support(s) 606 to be placed in a variety of locations.

In a preferred embodiment, a portion 102 of the divider 100 extends into the dispenser region thereby separating adjacent portions of the dispenser region.

In a preferred embodiment, the assembled apparatus is comprised of anchor system, a plurality of vertical dividers 100, front members 300, and dispenser 500. Cans 802, 902, 904, 906, 908 may be inserted into the assembled apparatus 800, 900 from the top (end opposite the dispenser). The process of filling the apparatus is 1) adjust a pair of vertical dividers 100 to be a distance apart approximately, and not less than, the height of the cans 802, 902, 904, 906, 908 to be stored and dispensed, 2) adjust the front member 300 on each vertical divider 100 to be a distance from the back 104 approximately, and not less than, the diameter of the cans 802, 902, 904, 906, 908 to be stored and dispensed, 3) insert cans 802, 902, 904, 906, 908 into the respective storage regions configured to hold them, and 4) remove cans 802, 902, 904, 906, 908 when desired from the dispensing region of the apparatus.

The foregoing detailed description provides exemplary embodiments of the invention and includes the best mode for practicing the invention. The description and illustration of these embodiments is intended only to provide examples of the invention, and not to limit the scope of the invention, or its protection, in any manner.

For purposes of this application, including claims, "substantially solid" means a surface which is rigid and which prevents the passage of articles the apparatus is designed to store and dispense.

For purposes of this application, including claims, "plurality" means one or more.

For purposes of this application, including claims, "series" means one or more.

For purposes of this application, including claims, distances between members are defined given their ordinary geometric meanings. When referring to substantially parallel members, the distance between the respective members is equal to length of the perpendicular lowered from a point on a plane. When referring to other than substantially parallel members, the distance between the respective members is the length of the shortest line segment having endpoints on the respective members.

The invention claimed is:

1. An apparatus configured to hold and dispense generally cylindrical items comprising:

A) a storage region comprising:

I) a plurality of back members,

II) a first substantially solid side member generally perpendicular to said plurality of back members, III) a second substantially solid side member generally parallel to the first substantially solid side member configured to be attachable multiple distances from the first substantially solid side member, and IV) a plurality of front members configured to be attached to at least one of said first substantially solid side member and said second substantially solid side member; and V) said plurality of front members configured to be attached to at least one of said first substantially solid side member and said second substantially solid side member are further configured to be attached a plurality of distances from said plurality of back members of said storage region B) a dispensing region at least partially below said storage region comprising:

I) a substantially solid back member,

II) a substantially solid bottom member,

III) a substantially solid front stop member configured to prevent generally cylindrical items in the dispensing region from moving further than a defined distance from said substantially solid back member of said dispensing region, IV) said substantially solid back member of said dispensing region is angled wherein an edge of said substantially solid back of said dispensing region adjacent said substantially solid bottom of said dispensing region is not in a plane defined by said substantially solid back member of said storage region; and C) a bottom of said storage region and a top of said dispensing region are configured to permit items to pass down out of said storage region into said dispensing region.

2. The apparatus of claim 1 wherein:

A) said plurality of front members configured to be attached to at least one of said first substantially solid side member and said second substantially solid side member are further configured to be attached a plurality of distances from said bottom of said storage region.

3. The apparatus of claim 2 wherein:

A) at least one of said first substantially solid side member of said storage region and said second substantially solid side member of said storage region are configured with a plurality of series of slots, and B) said plurality of front members of said storage region is configured with projections configured to cooperatively interface with said series of slots in said first substantially solid side member and said second substantially solid side member.

4. The apparatus of claim 3 wherein:

A) at least two of said series of slots are a different distance from an edge of said first substantially solid side member of said storage region or said second substantially solid side member of said storage region adjacent to said plurality of back members of said storage region.

5. The apparatus of claim 4 wherein:

A) at least two of said series of slots are different distances from said bottom of said first substantially solid side member of said storage region or said second substantially solid side member of said storage region.

6. The apparatus of claim 5 wherein:

A) said plurality of back members of said storage region are attached to at least one of said first substantially solid side member and said second substantially solid side member.

* * * * *